US006678974B1

(12) United States Patent
Su

(10) Patent No.: US 6,678,974 B1
(45) Date of Patent: Jan. 20, 2004

(54) CARD FILE DEVICE

(76) Inventor: Ken-Jui Su, 180, First Shu Wang Rd., Da Li City, Taichung Hsien (TW)

( * ) Notice: Subject to any disclaimer, the term of this patent is extended or adjusted under 35 U.S.C. 154(b) by 0 days.

(21) Appl. No.: 10/330,396

(22) Filed: Dec. 27, 2002

(51) Int. Cl.[7] ..... B65D 85/00; G09F 1/10
(52) U.S. Cl. ..... 40/124.2; 206/425
(58) Field of Search ..... 40/124.2; 229/67.1, 229/67.2; 206/425; 402/4; 211/128.1, 55

(56) References Cited

U.S. PATENT DOCUMENTS 1,596,661 A * 8/1926 Hutchings ..... 40/124.2
4,444,314 A * 4/1984 Jacobsson ..... 206/425
4,589,544 A * 5/1986 Schweinsberg ..... 206/740
2002/0179475 A1 * 12/2002 Kohana ..... 206/425

* cited by examiner

*Primary Examiner*—Cassandra H. Davis
(74) *Attorney, Agent, or Firm*—Alan D. Kamrath; Rider Bennett, LLP

(57) ABSTRACT

A card file device has a base board, a jacket, an envelopement, and a plurality of envelopes. The base board has a plurality of creases to define a flap plate, a first connection plate, a first main panel, a second connection plate, and a second main panel. A first fastener is disposed on the flap plate. A second fastener is disposed on the second main panel to match the first fastener. The flap plate has a circular aperture and a round aperture to receive a rope. A hook engages with the rope. A handle is disposed on the first connection plate. The jacket is disposed on the first main panel. The envelopes are disposed between the jacket and the envelopement. The second main panel covers the envelopement.

5 Claims, 6 Drawing Sheets

CARD FILE DEVICE

BACKGROUND OF THE INVENTION

The present invention relates to a card file device. More particualrly, the present invention relates to a card file device which will be converted to a display device conveniently.

Referring to FIGS. 1 and 2, a conventional card file has a first cover board 15, a base board 10 connected to the first cover board 15, a second cover board 17 connected to the base board 10, and a plurality of envelopes 20. A band 16 is disposed on the first cover board 15. The base board 10 has a plurality of spaced slots 11, a plurality of spaced creaves 14, a plurality of protruded bars 12, and a plurality of protruded plates 13. Each of the envelopes 20 has a first slit 24, a second slit 23, a pleated plate 22, and a flap plate 21. Each of the envelopes 20 is inserted in the corresponding slot 11 of the base board 10. Each of the protruded plates 13 is inserted through the corresponding first slit 24 of the envelope 20. Each of the protruded bars 12 is inserted through the corresponding second slit 23 of the envelope 20. When the conventional card file is closed, a thread 18 encloses the first cover board 15 and the second cover board 17. Since each of the envelopes 20 is separated and independent, a piece of paper will be inserted through a spacing between two envelopes 20.

SUMMARY OF THE INVENTION

An object of the present invention is to provide a card file device which will be converted to a display device conveniently.

Another object of the present invention is to provide a card file device which is easily extended.

Another object of the present invention is to provide a card file device which is easily folded.

Accordingly, a card file device comprises a base board, a jacket, an envelopement, and at least an envelope. The base board has a plurality of creases to define a flap plate, a first connection plate, a first main panel, a second connection plate, and a second main panel. The jacket is disposed on the first main panel. The envelope is disposed between the jacket and the envelopement. The second main panel covers the envelopement. The jacket has a rear portion adhered on the first main panel, and a front portion having a chink, a first crevice, a second crevice, a third crevice, and a fourth crevice. The envelope has a rear portion having a guide plate inserted through the chink of the jacket, a first insertion plate inserted through the first crevice and the third crevice of the jacket, a second insertion plate inserted through the second crevice and the fourth crevice of the jacket, and a label bar, and a front portion having a fissure, a first cranny, a second cranny, a third cranny, and a fourth cranny. The envelopement has a rear portion having a guide bar inserted through the fissure of the envelope, a first insertion plate inserted through the first cranny and the third cranny of the envelope, and a second insertion plate inserted through the second cranny and the fourth cranny of the envelope, and a front portion having a first linear slit and a second linear slit.

DETAILED DESCRIPTION OF THE INVENTION

Figure 1:
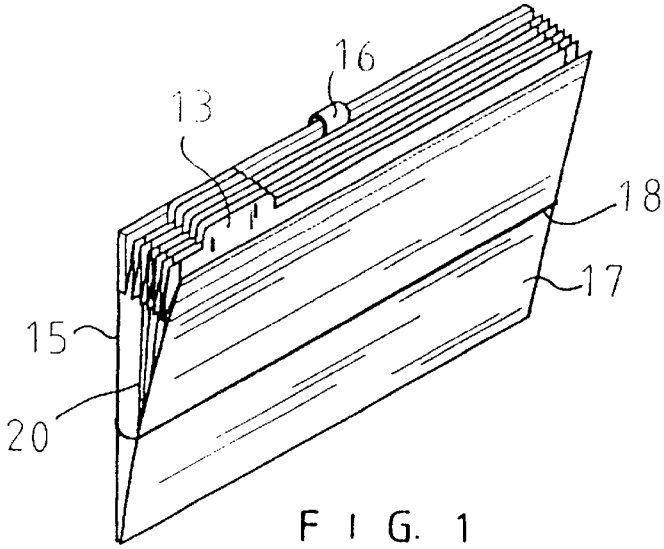
FIG. 1 PRIOR ART
FIG. 1 is a perspective assembly view of a card file of the prior art.
Figure 2:
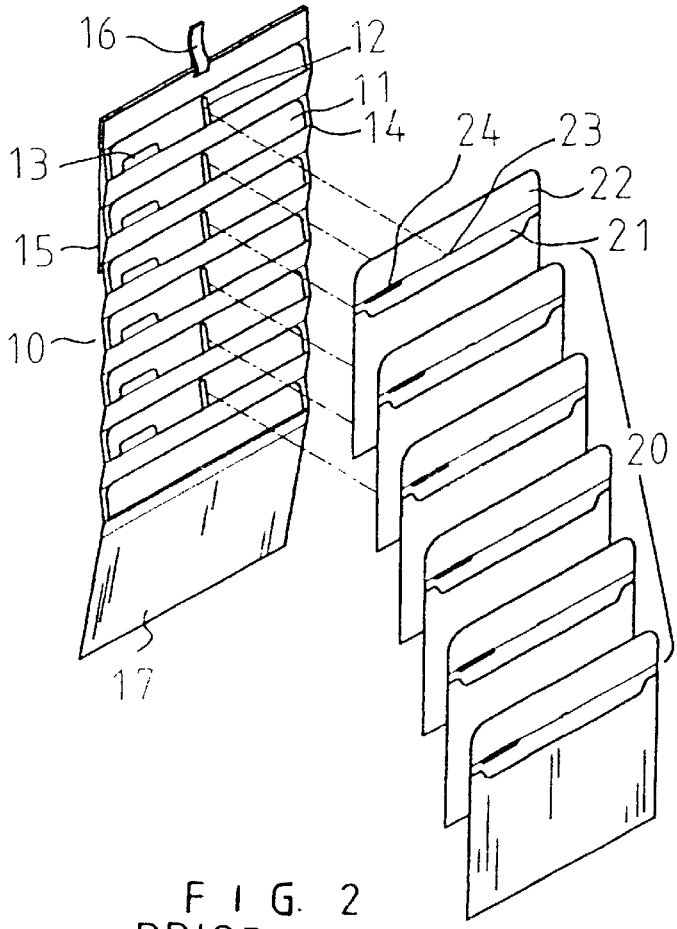
FIG. 2 PRIOR ART
FIG. 2 is a perspective exploded view of a card file of the prior art.
Figure 3:
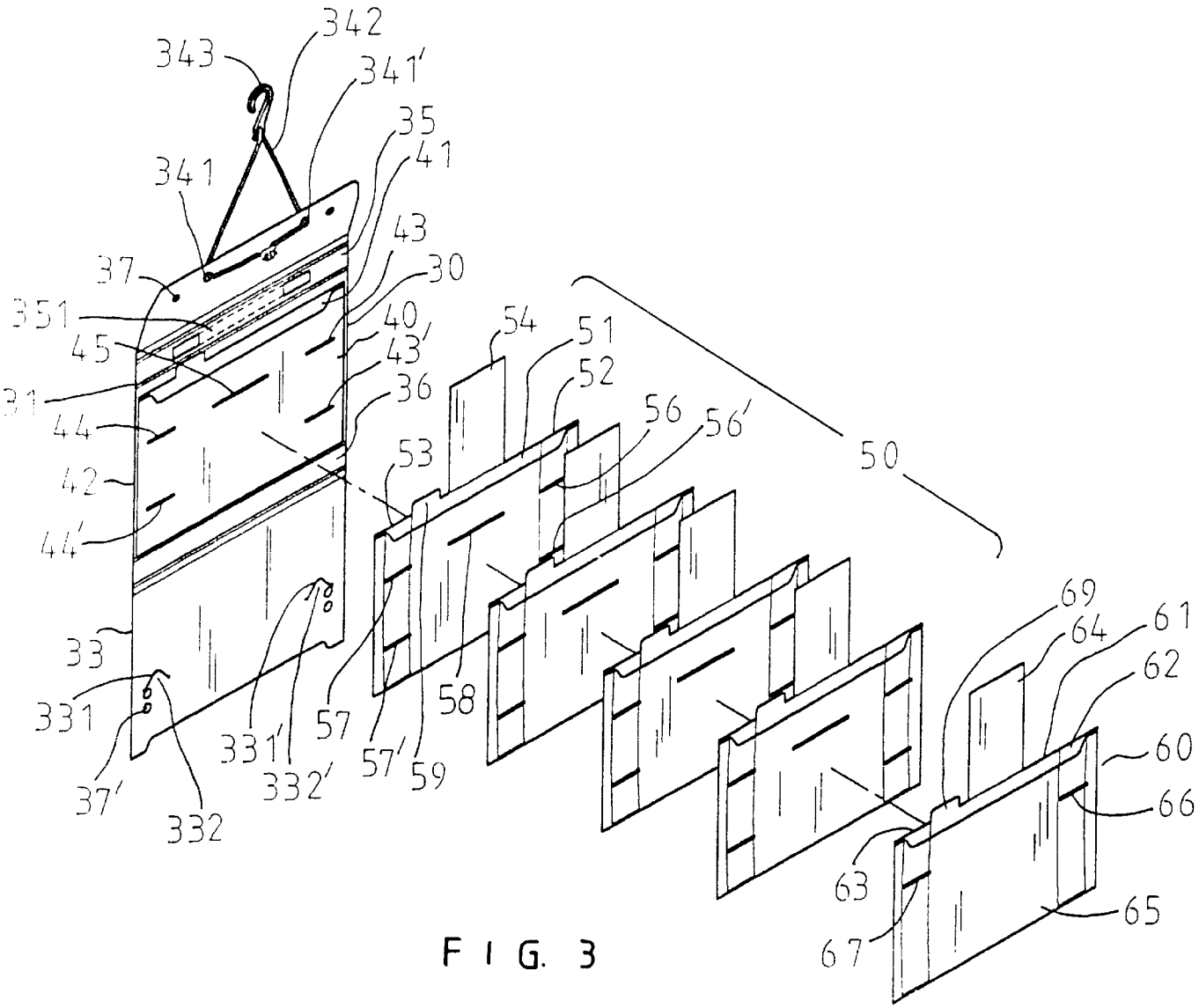
FIG. 3 is a perspective exploded view of a card file device of a preferred embodiment in accordance with the present invention.
Figure 4:
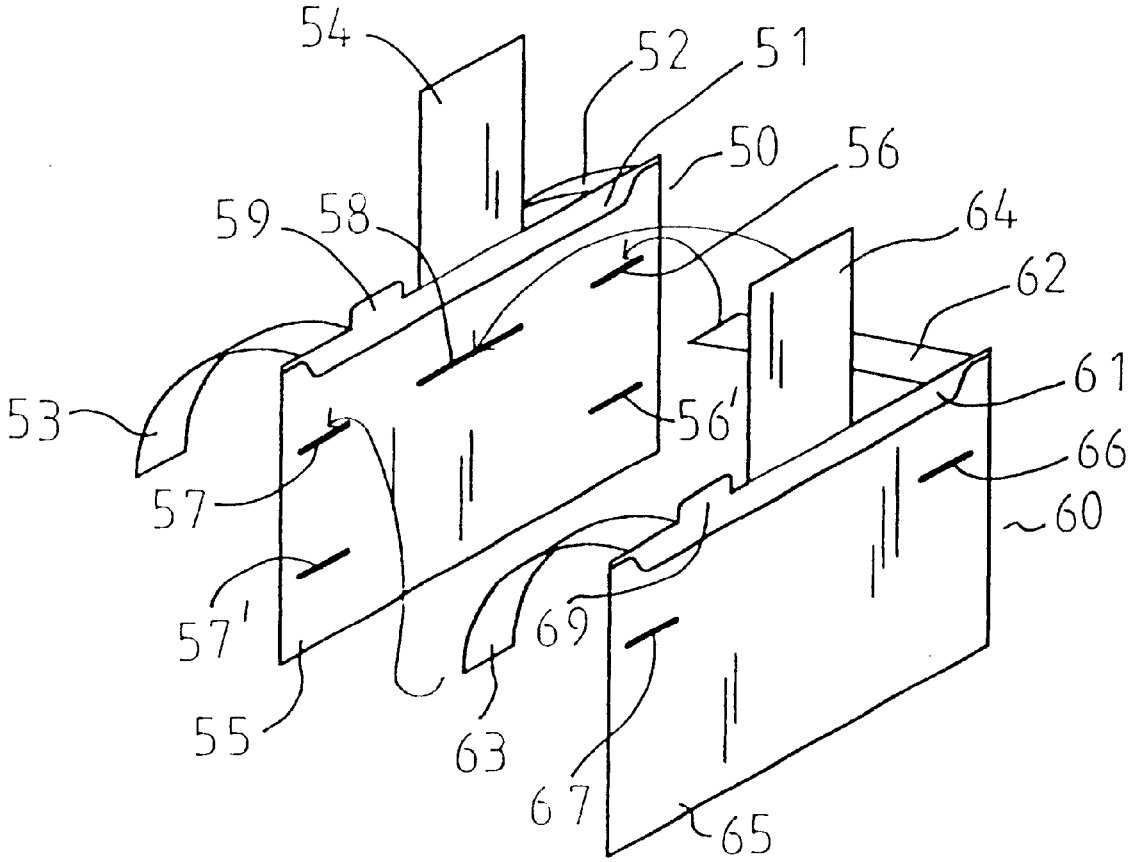
FIG. 4 is a schematic view illustrating an insertion bar of an envelopment inserted through a cranny of an envelope of a preferred embodiment in accordance with the present invention.
Figure 5:
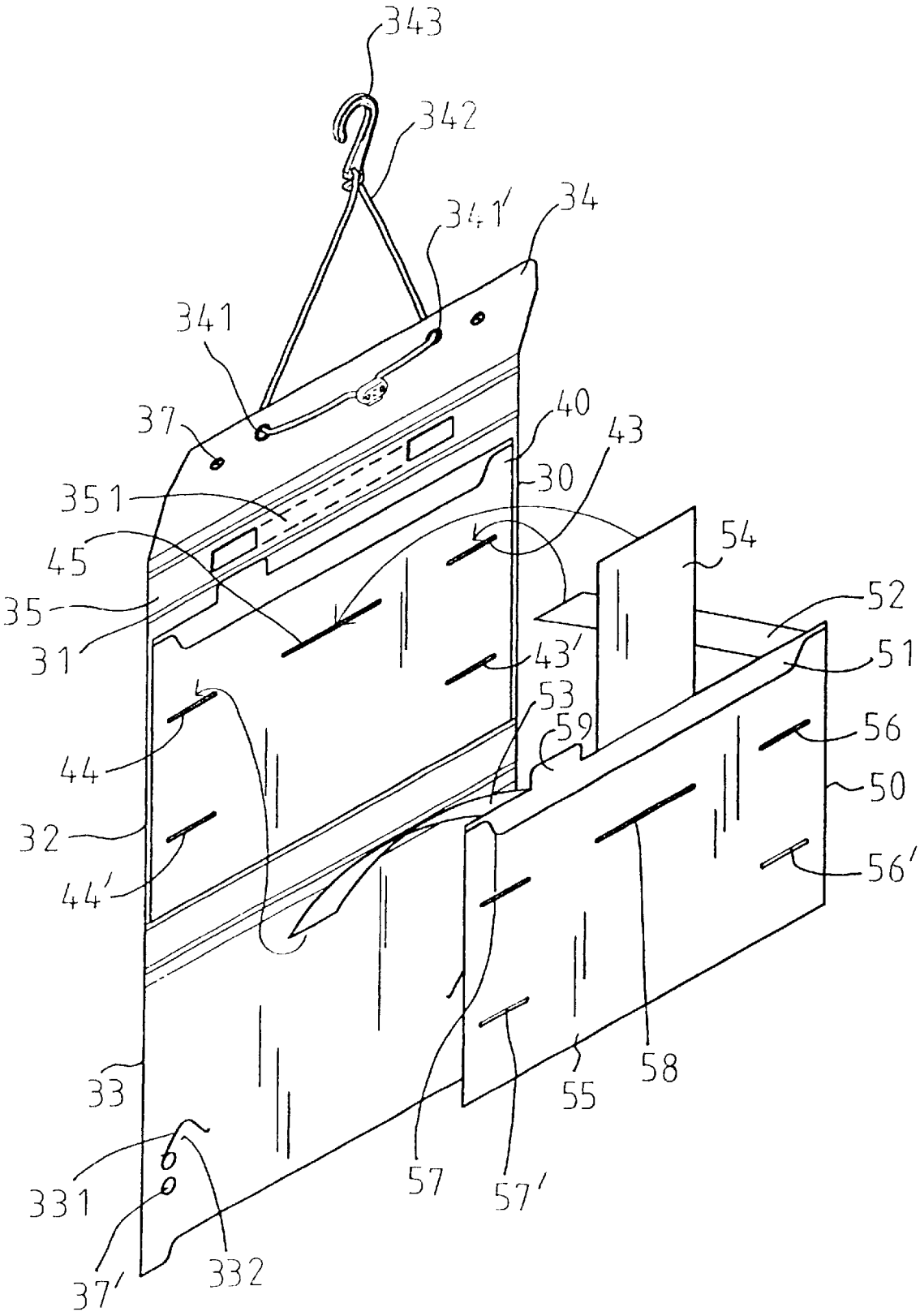
FIG. 5 is a schematic view illustrating an insertion plate of an envelope inserted through a crevice of a jacket and a guide plate of the envelope inserted through a chink of the jacket of a preferred embodiment in accordance with the present invention.
Figure 6:
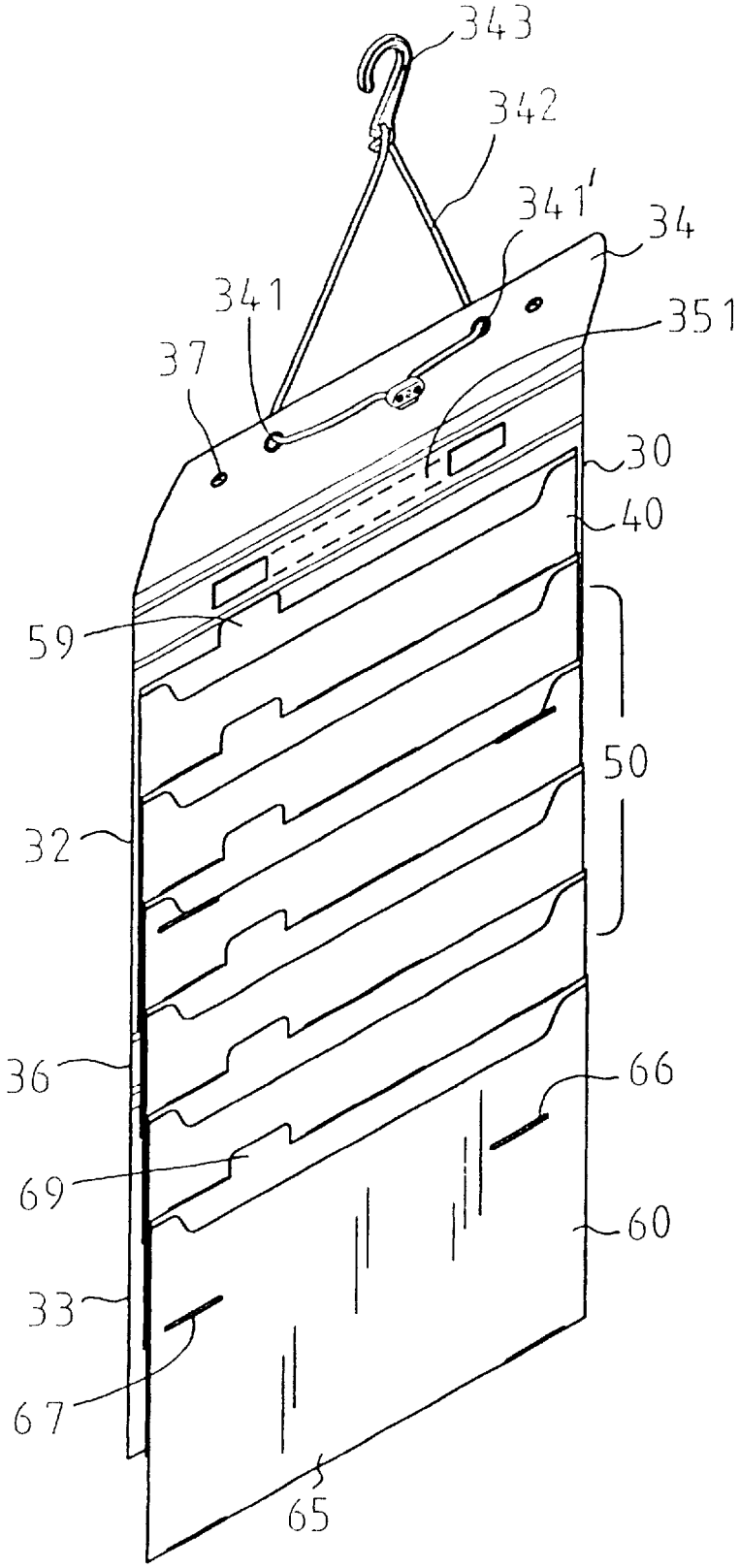
FIG. 6 is a perspective assembly view of a card file device of a preferred embodiment while the card file device is opened.
Figure 7:
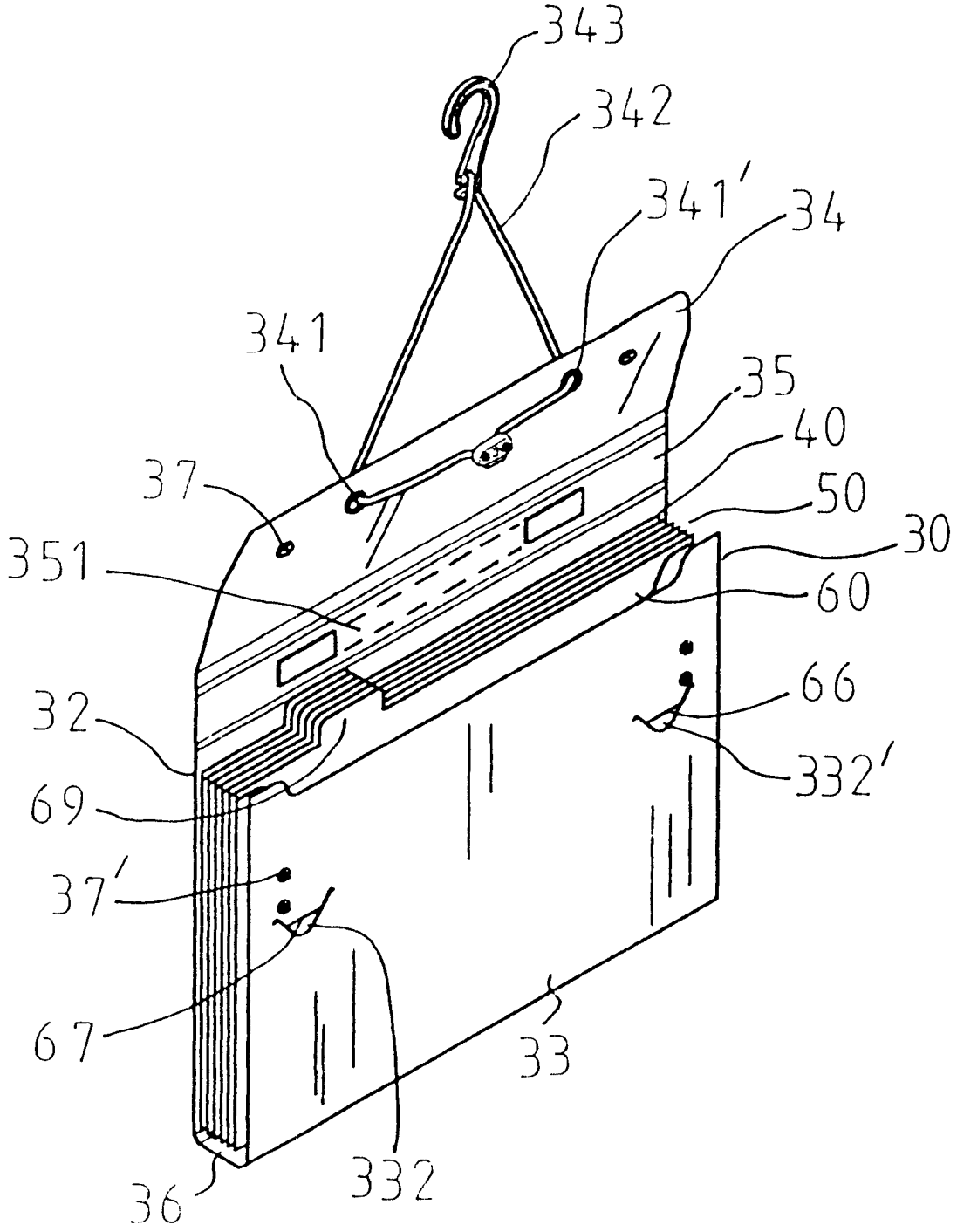
FIG. 7 is a perspective assembly view of a card file device of a preferred embodiment while the card file device is closed and a flap plate is opened.

Referring to FIGS. 3 to 7, a card file device comprises a base board 30, a jacket 40, an envelopement 60, and a plurality of envelopes 50.

The base board 30 has a plurality of creases 31 to define a flap plate 34, a first connection plate 35, a first main panel 32, a second connection plate 36, and a second main panel 33.

The jacket 40 is disposed on the first main panel 32.

The envelopes 50 are disposed between the jacket 40 and the envelopement 60.

The second main panel 33 covers the envelopement 60.

The jacket 40 has a rear portion 41 adhered on the first main panel 32, and a front portion 42 having a chink 45, a first crevice 43, a second crevice 44, a third crevice 43', and a fourth crevice 44'.

Each of the envelopes 50 has a rear portion 51 having a guide plate 54 inserted through the chink 45 of the jacket 40, a first insertion plate 52 inserted through the first crevice 43 and the third crevice 43' of the jacket 40, a second insertion plate 53 inserted through the second crevice 44 and the fourth crevice 44' of the jacket 40, and a label bar 59, and a front portion 55 having a fissure 58, a first cranny 56, a second cranny 57, a third cranny 56', and a fourth cranny 57'.

The envelopement 60 has a rear portion 61 having a guide bar 64 inserted through the fissure 58 of the corresponding envelope 50, a first insertion plate 52 inserted through the first cranny 56 and the third cranny 56' of the corresponding envelope 50, a second insertion plate 53 inserted through the second cranny 57 and the fourth cranny 57' of the corresponding envelope 50, and a label portion 69, and a front portion 65 having a first linear slit 67 and a second linear slit 66.

At least a first fastener 37 is disposed on the flap plate 34.

At least a second fastener 37' is disposed on the second main panel 33 to match the first fastener 37.

The flap plate 34 has a circular aperture 341 and a round aperture 341' to receive a rope 342.

A hook 343 engages with the rope 342.

A handle 351 is disposed on the first connection plate 35.

The second main panel 33 has a first curved slit 331 to define a first tongue 332 and a second curved slit 331' to define a second tongue 332'.

The first tongue 332 is inserted in the first linear slit 67 of the envelopement 60.

The second tongue 332' is inserted in the second linear slit 66 of the envelopement 60.

Referring to FIG. 6 again, the base board 30 is extended. Each of the envelopes 50 will move downward. The envelopement 60 will move downward also.

Referring to FIG. 7 again, the base board 30 is folded. The first tongue 332 is inserted in the first linear slit 67 of the envelopement 60, and the second tongue 332' is inserted in the second linear slit 66 of the envelopement 60.

The present invention has the following advantages. The card file device will be converted to a display device conveniently. The card file device is easily extended. The card file device is easily folded.

I claim:

1. A card file device comprises:

a base board, a jacket, an envelopement, and at least an envelope, the base board having a plurality of creases to define a flap plate, a first connection plate, a first main panel, a second connection plate, and a second main panel, the jacket disposed on the first main panel, the envelope disposed between the jacket and the envelopement, the second main panel covering the envelopement, the jacket having a rear portion adhered on the first main panel, and a front portion having a chink, a first crevice, a second crevice, a third crevice, and a fourth crevice, the envelope having a rear portion having a guide plate inserted through the chink of the jacket, a first insertion plate inserted through the first crevice and the third crevice of the jacket, a second insertion plate inserted through the second crevice and the fourth crevice of the jacket, and a front portion having a fissure, a first cranny, a second cranny, a third cranny, and a fourth cranny, the envelopement having a rear portion having a guide bar inserted through the fissure of the envelope, a first insertion plate inserted through the first cranny and the third cranny of the envelope, and a second insertion plate inserted through the second cranny and the fourth cranny of the envelope, and a front portion having a first linear slit and a second linear slit.

2. The card file device as claimed in claim 1, wherein a first fastener is disposed on the flap plate and a second fastener is disposed on the second main panel to match the first fastener.

3. The card file device as claimed in claim 1, wherein the flap plate has a circular aperture and a round aperture to receive a rope, and a hook engages with the rope.

4. The card file device as claimed in claim 1, wherein a handle is disposed on the first connection plate.

5. The card file device as claimed in claim 1, wherein the second main panel has a first curved slit to define a first tongue and a second curved slit to define a second tongue, the first tongue is inserted in the first linear slit of the envelopement, and the second tongue is inserted in the second linear slit of the envelopement.

* * * * *